US010834487B1

(12) United States Patent
Coleman, V

(10) Patent No.: US 10,834,487 B1
(45) Date of Patent: Nov. 10, 2020

(54) WALL ART MUSIC SPEAKER SYSTEM

(71) Applicant: Charles Douglass Coleman, V, Harper Woods, MI (US)

(72) Inventor: Charles Douglass Coleman, V, Harper Woods, MI (US)

( * ) Notice: Subject to any disclaimer, the term of this patent is extended or adjusted under 35 U.S.C. 154(b) by 0 days.

(21) Appl. No.: 16/417,989

(22) Filed: May 21, 2019

Related U.S. Application Data

(60) Provisional application No. 62/917,294, filed on Dec. 3, 2018.

(51) Int. Cl.

| | |
|---|---|
| ***H04R 5/02*** | (2006.01) |
| ***H04R 5/04*** | (2006.01) |
| ***H04R 1/02*** | (2006.01) |
| ***A47G 1/06*** | (2006.01) |

(52) U.S. Cl.
CPC ..... *H04R 1/023* (2013.01); *A47G 1/0616* (2013.01); *H04R 5/02* (2013.01); *H04R 5/04* (2013.01); *A47G 2200/143* (2013.01); *H04R 2420/07* (2013.01)

(58) Field of Classification Search
CPC . H04R 1/023; H04R 5/02; H04R 5/04; H04R 2420/07; A47G 1/0616; A47G 2200/143
USPC ..... 381/332, 431; 455/140, 456.4, 566; 160/371; 52/28
See application file for complete search history.

(56) References Cited

U.S. PATENT DOCUMENTS

| | | | | |
|---|---|---|---|---|
| 6,837,495 | B2 | 1/2005 | Gerson et al. | 273/372 |
| 7,953,382 | B1 * | 5/2011 | Clement | H04B 1/034 455/140 |
| 9,311,834 | B2 | 4/2016 | Lee et al. | |
| 2006/0140439 | A1 * | 6/2006 | Nakagawa | H04R 1/025 381/431 |
| 2007/0273550 | A1 | 11/2007 | Price et al. | 340/870.3 |
| 2009/0107083 | A1 | 4/2009 | Call et al. | 52/745.21 |
| 2009/0273543 | A1 | 11/2009 | McVinney | 345/60 |
| 2010/0240417 | A1 * | 9/2010 | Wickman | H04W 52/027 455/566 |
| 2012/0267062 | A1 * | 10/2012 | Ainge | B44D 3/18 160/371 |
| 2013/0156243 | A1 | 6/2013 | Hagman | 381/333 |
| 2015/0086048 | A1 | 3/2015 | Brown et al. | 381/152 |

(Continued)

FOREIGN PATENT DOCUMENTS

| | | | | |
|---|---|---|---|---|
| CN | 203883955 U | * | 10/2014 | |
| WO | WO-9709843 A1 | * | 3/1997 | H04R 1/025 |

*Primary Examiner* — Vivian C Chin
*Assistant Examiner* — Friedrich Fahnert
(74) *Attorney, Agent, or Firm* — Christopher P. Maiorana, PC

(57) ABSTRACT

An apparatus comprising a frame, a flexible material, a speaker, and a controller. The frame may be configured to provide a rigid edge about a generally rectangular shape. The flexible material may cover a front of the frame and secured to a back of said frame such that (i) a the rigid edge supports the canvas and (ii) a middle portion of the flexible material is not supported by the frame. The speaker may be connected directly to the middle portion of the flexible material. The controller may be (i) electrically connected to the speakers and (ii) configured to provide a music signal capable of driving the speaker to produce audible music. The flexible material supports the speaker.

15 Claims, 6 Drawing Sheets

(56) References Cited

U.S. PATENT DOCUMENTS

| | | | | |
|---|---|---|---|---|
| 2016/0178145 | A1* | 6/2016 | Oleske | E04B 9/241<br>52/28 |
| 2016/0205238 | A1* | 7/2016 | Abramson | G01C 21/3641<br>455/456.4 |
| 2019/0123929 | A1* | 4/2019 | Lee | G08C 17/02 |

* cited by examiner

WALL ART MUSIC SPEAKER SYSTEM

This application relates to U.S. Provisional Application No. 62/917,294, filed Dec. 3, 2018, which is hereby incorporated by reference in its entirety.

FIELD OF THE INVENTION

The invention relates to audio speakers generally and, more particularly, to a method and/or apparatus for implementing a wall art music speaker system.

BACKGROUND

When decorating a house, apartment, office, or other area, people tend to like to place personalized items to have a custom effect. Quite often, space is limited. Implementing more than one different class of item in a certain space would be beneficial.

It would be desirable to implement wall art music speaker system to allow customization of a space in an efficient manor.

SUMMARY

The invention concerns an apparatus comprising a frame, a flexible material, a speaker, and a controller. The frame may be configured to provide a rigid edge about a generally rectangular shape. The flexible material may cover a front of the frame and secured to a back of said frame such that (i) a rigid edge supports the canvas and (ii) a middle portion of the flexible material is not supported by the frame. The speaker may be connected directly to the middle portion of the flexible material. The controller may be (i) electrically connected to the speakers and (ii) configured to provide a music signal capable of driving the speaker to produce audible music. The flexible material supports the speaker.

BRIEF DESCRIPTION OF THE FIGURES

Embodiments of the invention will be apparent from the following detailed description and the appended claims and drawings in which:

DETAILED DESCRIPTION OF THE EMBODIMENTS

Embodiments of the present invention include providing a wall art music system that may (i) provide a fusion of art and entertainment, (ii) allow flexibility in decorating an area, (iii) implement an all-in-one visual/audio experience and/or (vi) be implemented to save space by combining a decorative picture and a sound system.

The wall art music system described may be a fusion of art and entertainment—a customized, portable, hanging, canvas-mounted art integrated with a music system. The wall art music system may allow a customer to decorate a home, office, or other space with a custom, canvas-mounted custom curated music system.

A customer may play a part in the creation of the wall art music system by selecting a photograph or painting. The selected photograph may be turned into an electronic media entertainment showpiece. The showpiece may be both visually and audibly entertaining.

In an example, the selected photograph may commemorate a precious memory like a graduation, the birth of a child, a wedding, etc. The system may be a keepsake that connects with its audience as it entertains. The system may integrate electronic media to play AM/FM stereo, a micro USB card to play stored music files or may receive Bluetooth or WiFi systems. A user may enjoy music, audio books and/or any other audible media.

The system may be remote controlled to operate up to a distance (e.g., 15-feet or more). The system may be powered by either battery or an AC outlet. In bluetooth mode, the system may allow the user to answer a telephone call. The system may provide an integrated microphone to allow a user to have a telephone conversation while in close proximity to the system.

Figure 1:
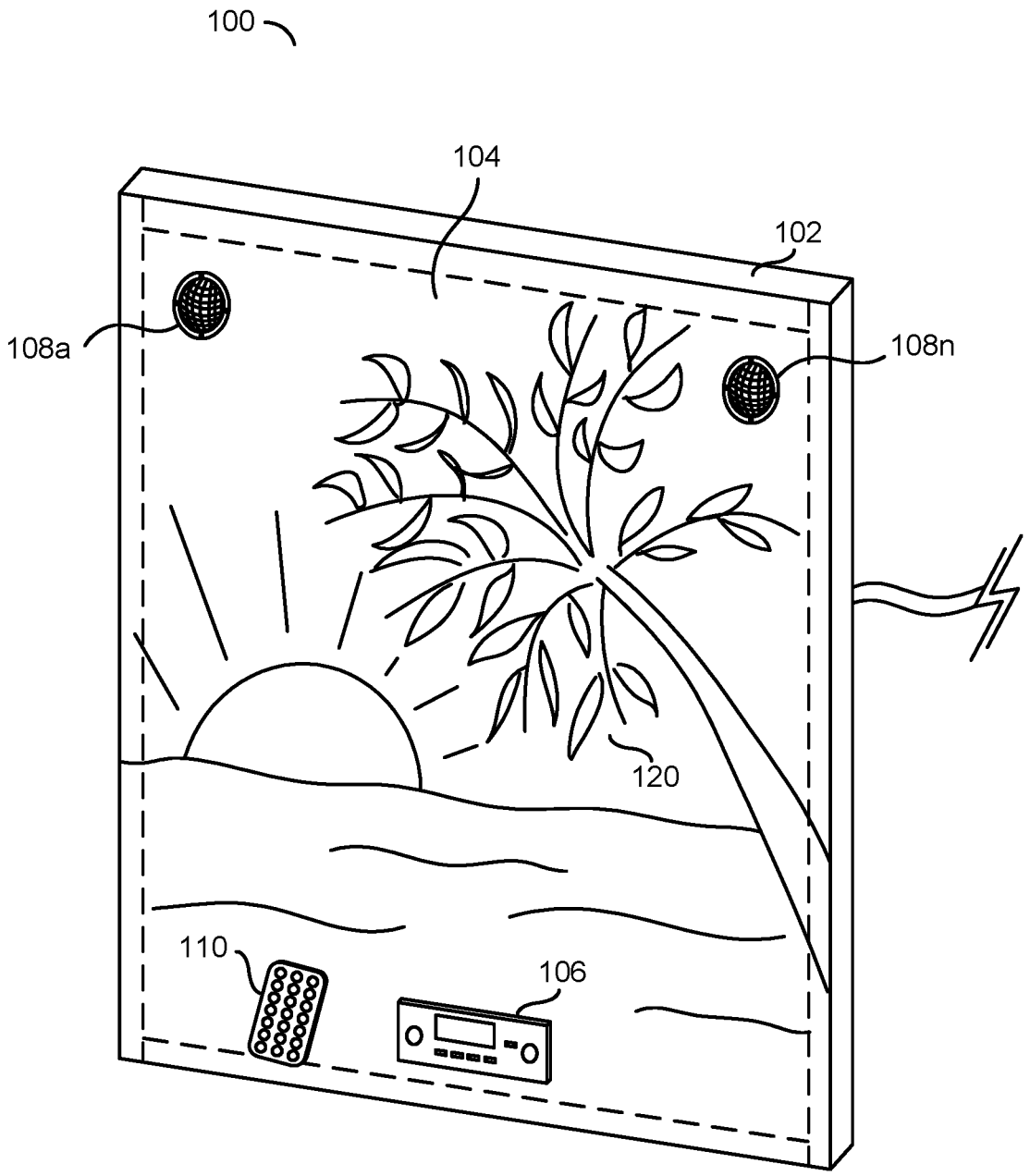
FIG. 1 is a diagram showing a perspective view of an implementation of an example wall art system.

Referring to FIG. 1, a block diagram of an apparatus 100 is shown in accordance with an embodiment of the invention. The apparatus 100 may implement a wall art music system. The apparatus 100 generally comprises a frame 102, a material 104, a receiver 106, and one or more speakers 108*a*-108*n*. A remote control 110 may also be implemented. The remote control 110 may be connected to the apparatus 100 using a magnet (not shown). Other fasteners, such as a hook and loop system, may also be implemented to removably connect the remote control 110 the apparatus 120. The remote control 110 is normally easily accessible and/or removable.

The speakers 108*a*-108*n* may be connected to the material 104 using one or more screws (to be described in more detail in connection with FIG. 6). The material 104 may be implemented as a flexible material, such as a canvas, a plastic sheet, etc. In one example, the material 104 may be implemented as the canvas. In general, the material 104 may be a photo surface. A design (or photograph) 120 may be printed on the material 104. The apparatus 100 shows an example of a picture of a plant. However, other pictures may be implemented to meet the design criteria of a particular implementation. A photo may be printed on a canvas embodiment of the material 104 to provide a strong, coarse cloth. In another example, the material 104 may be made from hemp, flax, cotton, or a similar yarn.

The photo on the material 104 may be mounted in or on a glass frame 102. Other implementations of the material 104 may also be used. For example, a photo on paper, a photo on plastic, a photo on glass, a photo on styrofoam, a photo on a wood photo transfer, a photo on acrylic, a photo on metal, a photo on forex (hard-foam plate), etc. A photo on frame with passe-partout may also be implemented. A digital photo frame that changes images that are loaded onto digital storage system of the frame 102 may also be used. A digital photo frame that changes images through internet based cell phone application may also be used.

In one example, the frame 102 may be implemented as a wood frame. The frame 102 may be wall mountable or may be able to be used as a table top frame. The frame 102 may be composed of, but not limited to, one or more of a variety of materials such as acrylic (or an acrylic mounted frame), visible or non-visible, glass (or a glass mounted frame), and/or a visible (or non-visible). A plastic (or plastic mounted frame) may also be implemented. Such a plastic version of the frame 102 may be visible or non-visible. In an example, a PVC or PVC mounted frame 102 may be implemented. Such a PVC frame may be visible or non-visible. In another example, a fiber reinforced plastic (FRP) frame 102, or FRP mounted frame may also be implemented (e.g., either visible or non-visible). A fiberglass (or fiberglass mounted frame) may be implemented, visible or non-visible. A metal/metal alloy (or metal/metal alloy mounted frame) may be implemented (e.g., visible or non-visible).

Figure 2:
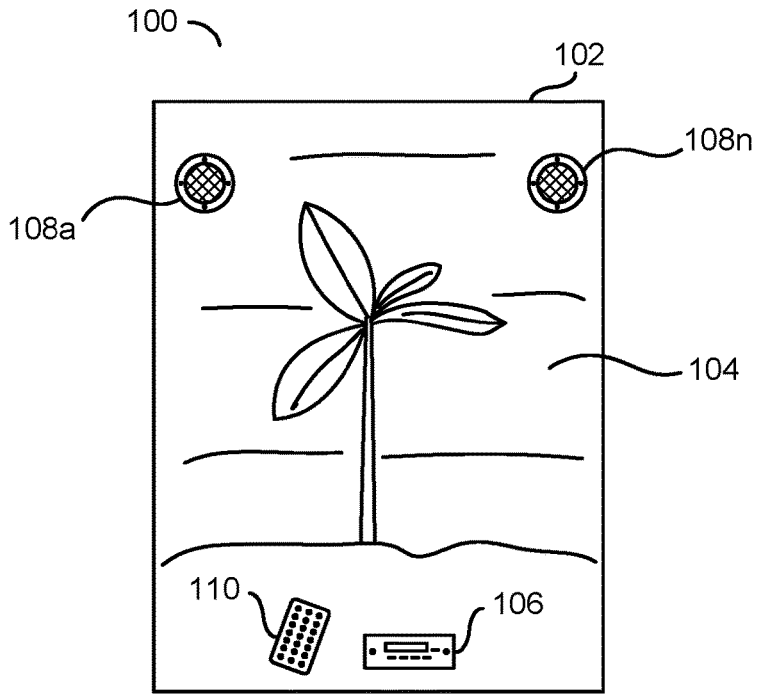
FIG. 2 is a diagram illustrating a front view.

Referring to FIG. 2, a front view of the apparatus 100 is shown. The speakers 108*a*-108*n* are shown pointing generally outward from the apparatus 100. However, the direction of the speakers 108*a*-108*n* may be varied to meet the design criteria of a particular implementation. The particular number of speakers 108*a*-108*n* may also be varied. For example, certain implementations may only implement one of the speakers 108*a*-108*n*. Other implementations may have more than two of the speakers 108*a*-108*n*.

The speaker 108*a*-108*n* may be implemented as Bluetooth speakers with grill mount location. Bluetooth speakers 108*a*-108*n* may have varying speaker sizes, various speaker strength, etc. The speakers 108*a*-108*n* may be mounted on the material 104.

The speakers 108*a*-108*n* may be implemented with or without a grill (e.g., cover) and/or may have various mounting locations. The Bluetooth implemented speakers 108*a*-108*n* (e.g., with varying speaker sizes, various speaker strength, etc.) may be mounted on the frame 102, or integrated into frame 102. The speakers 108*a*-108*n* may be visible or non-visible and/or may be composed of, but not limited to, materials such as wood, acrylic glass mounted frame, plastic frame, PVC frame, fiber reinforced frame, fiberglass frame, metal/metal alloy frame.

In an example of the Bluetooth enabled speakers 108*a*-108*n* (with varying speaker sizes, various speaker strength) such speakers may be mounted on the picture surface in the material 104. The speakers 108*a*-108*n* may be viable or non-viable and/or may be composed of, but not limited to, materials such as canvas mounted in or on a glass frame, photo on paper, photo on plastic, photo on glass, photo on Styrofoam, wood photo transfer, photo on acrylic, photo on metal, photo on forex (hard-foam plate), photo frame with passe-partout, a digital photo frame that changes images that are loaded onto digital storage system of frame, a digital photo frame that changes images through internet based cell phone application.

Figure 3:
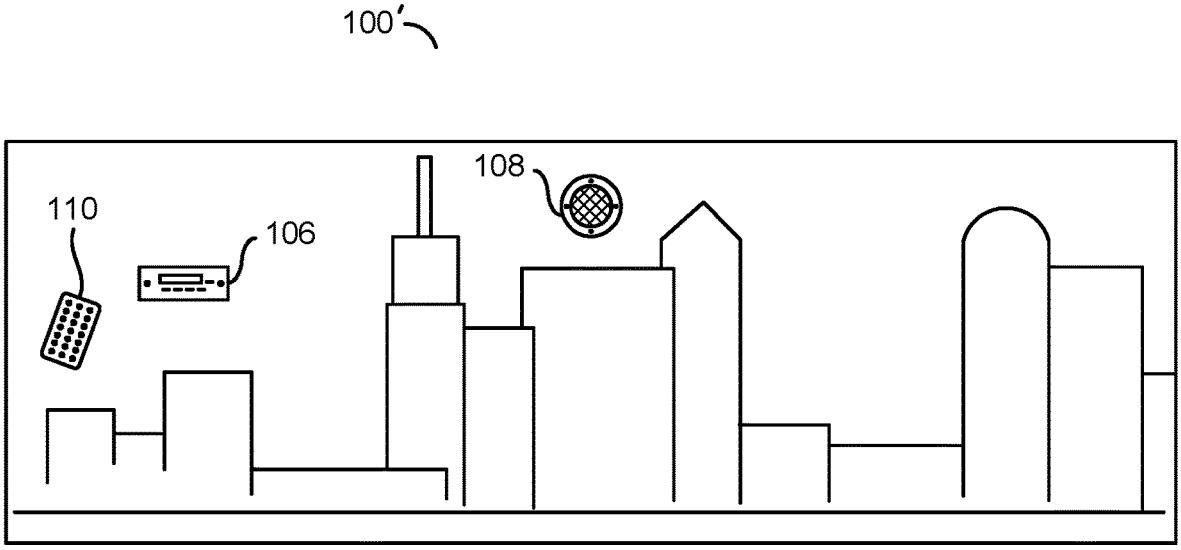
FIG. 3 is a diagram illustrating a first view of an alternate size of a wall art implementation.

Referring to FIG. 3, a front view of an alternate sized apparatus 100 is shown. The apparatus 100' is shown having a generally wider rectangular shape size compared with the apparatus 100 of FIG. 1. A single speaker 108 is shown. The apparatus 100' shows a picture of a city. The particular picture shown may be varied to meet the design criteria of a particular implementation.

Figure 4:
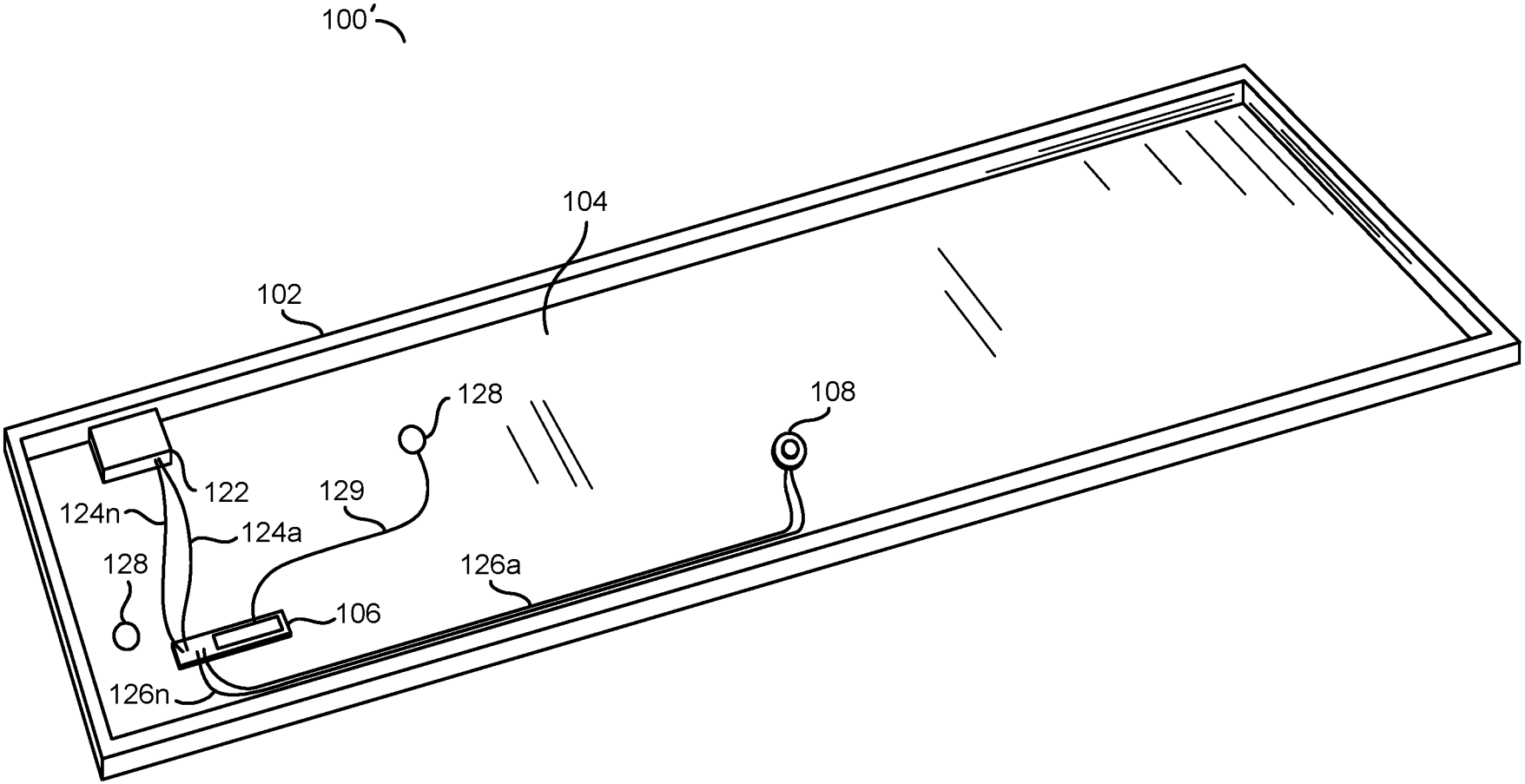
FIG. 4 is a diagram illustrating a back side.

Referring to FIG. 4, a back side of the apparatus 100' is shown. A magnet 128 is shown connected to the back of the canvas 104. A power source 122 is also shown. The power source 122 may be connected to the controller 106 by one or more wires 124*a*-124*n*. The controller 106 may be connected to the speaker 108 by one or more wires 126*a*-126*n*. While the speaker 108 is shown as a relatively small speaker, the particular size of the speaker 108 may be varied to meet the design criteria of a particular implementation. For example, if the aesthetic requirement of the apparatus 100' calls for a small speaker (e.g., to not interrupt the flow of the art work), a small speaker 108 may be implemented. However, a larger speaker 108 may be implemented in an effort to provide additional sound volume and/or sound quality. A microphone 128 is also shown. The microphone 128 may be connected to the receiver 106 through a wire 129. The microphone may allow the receiver 106 to operate as a telephone and/or voice recognition device. The frame 102 is shown having generally four sides. The sides may be made from wood, plastic, or other appropriate material. In general, the frame 102 may be made using a lightweight material. In one example, the frame 102 may be customized to have a particular height and width.

Figure 5:
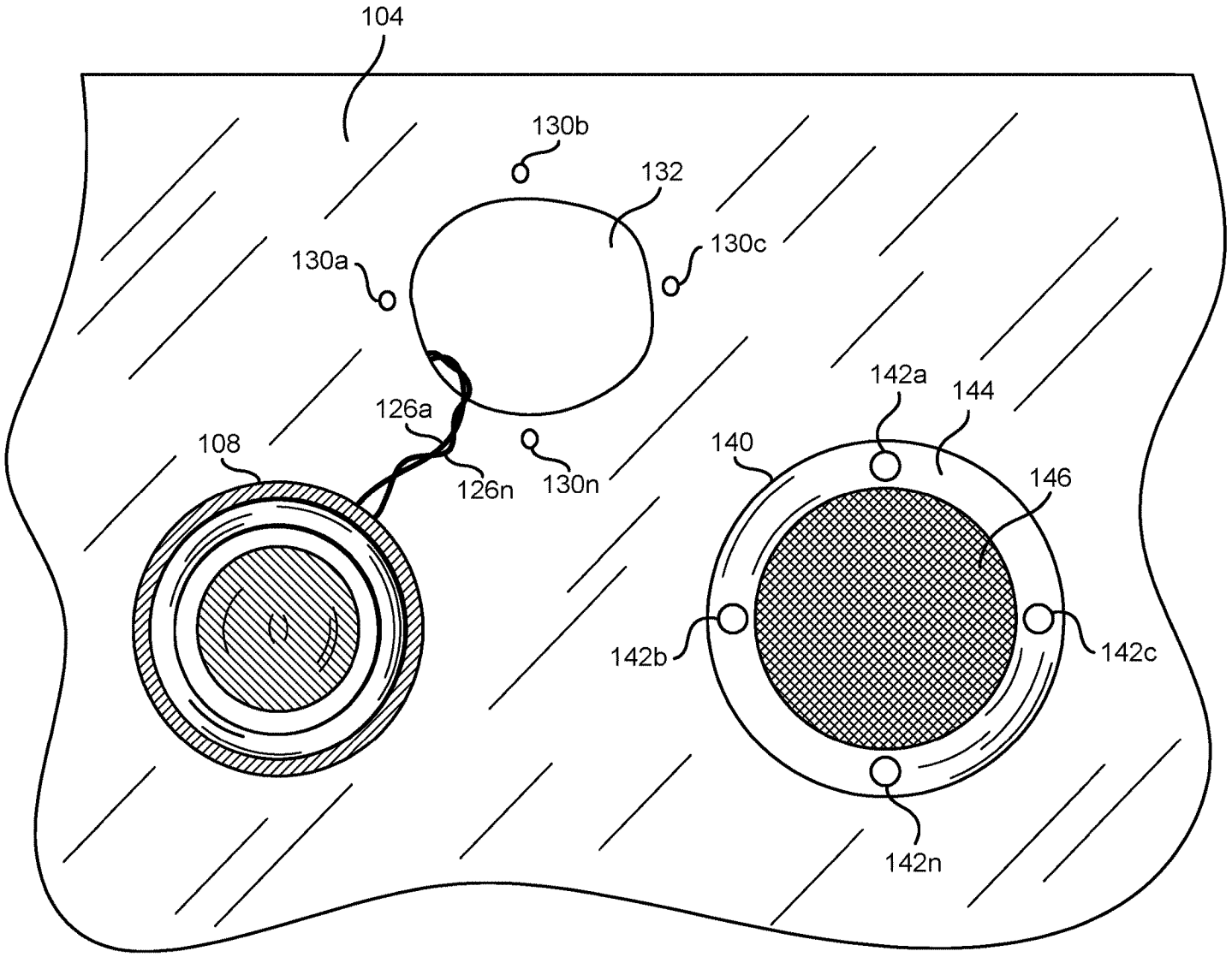
FIG. 5 is a diagram illustrating a connection of a speaker.

Referring to FIG. 5, a connection of a speaker 108 is shown. A number of small holes 130*a*-130*n* are shown. A larger hole 132 is also shown. The speaker 108 is shown generally disconnected from the hole 132. The wires 126*a*-126*n* are shown connected to the speaker 108. A cover 140 is also shown. The cover 140 generally is placed over the speaker 108. The cover 140 may have a number of holes 142*a*-142*n* that generally correspond to the holes in the material 104. An outer area 144 is shown containing holes 142*a*-142*n*. The outer area 144 may form a gasket that makes contact with the material 104. A grill type material 146 is shown on the center part of the cover 140. The grill 146 may be implemented with an acoustically transparent material.

Figure 6:
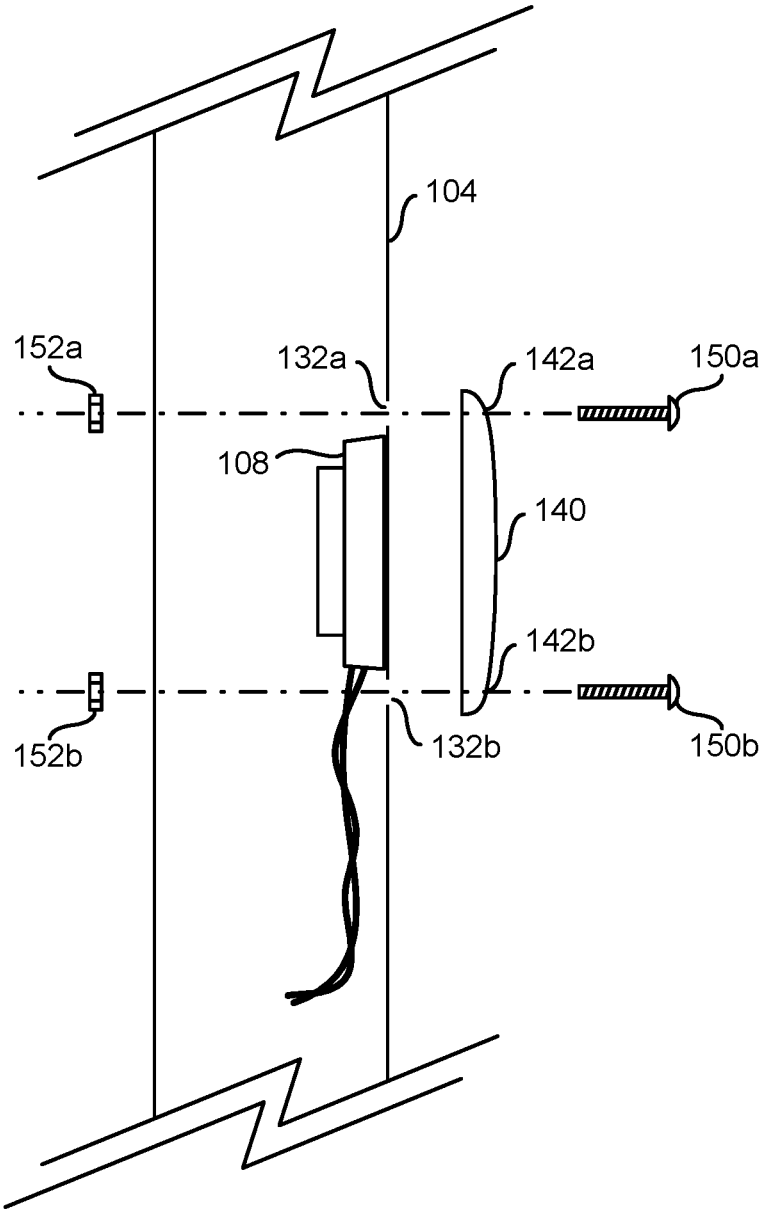
FIG. 6 is a more detailed diagram illustrating a side view of the speaker.

Referring to FIG. 6, a more detailed side view of the speaker 108 is shown. The cover 140 is shown with the holes 142*a* and 142*b*. The holes 142*a* and 142*b* generally line up with the holes 132*a* and 132*b*. The holes 142*c* and 142*n* are not shown in FIG. 6. Similarly, the holes 132*c* and 132*n* are not shown in FIG. 6. A fastener 150*a* and a fastener 150*b* are shown in a generally exploded view. The fastener 150*a* generally connects to the fastener 152*a* through the hole 142*a* and the hole 132*a*. Similarly, the fastener 150*b* generally connects to the fastener 152*b* through the hole 132*b* and the hole 142*b*. The connection of the fastener 152*a* and the fastener 152*a* and the fastener 150*b* and 152*b* shows an example of how to connect the speaker to the material 104.

Figure 7:
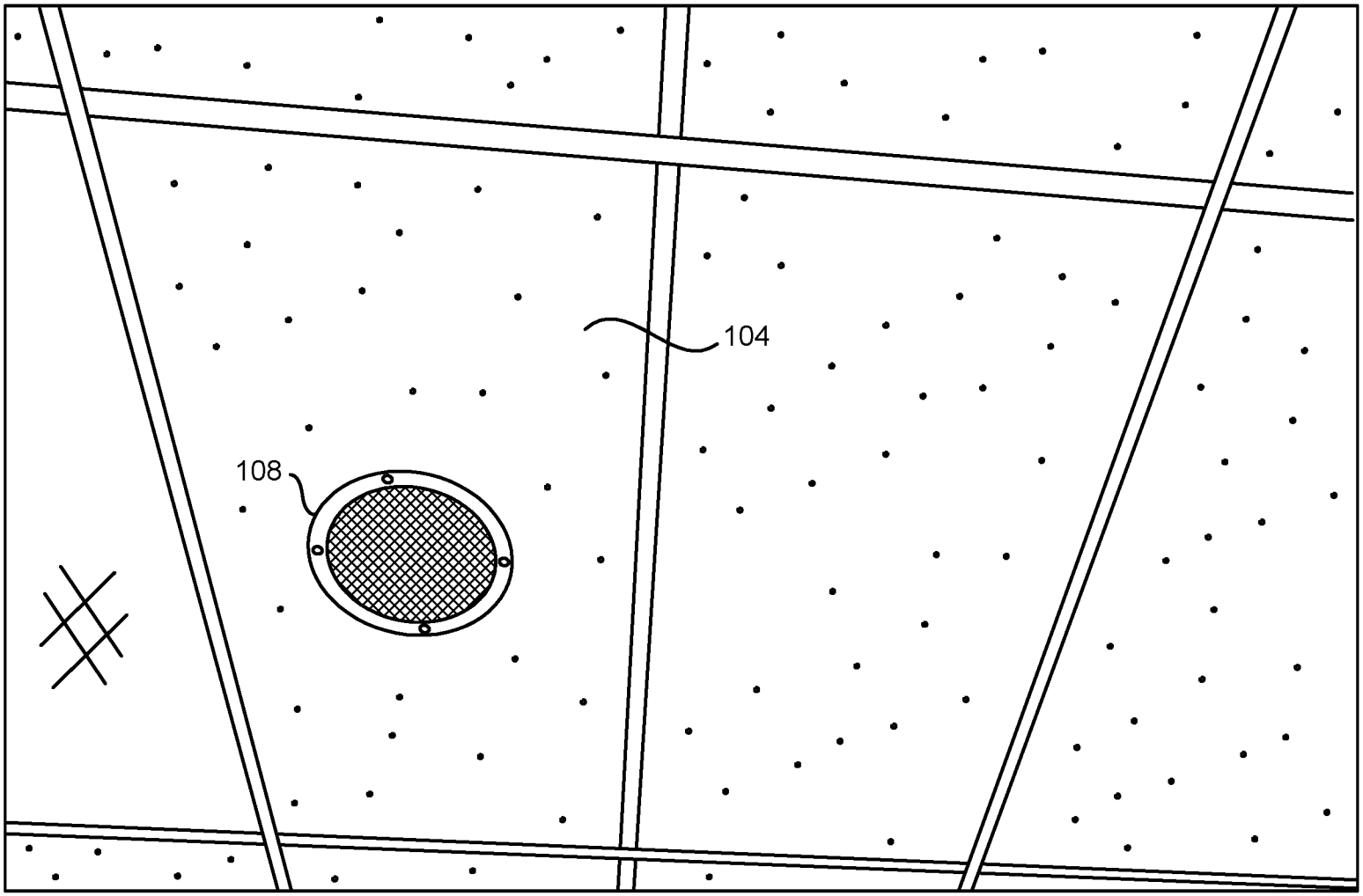
FIG. 7 is a diagram of a ceiling implementation.

Referring to FIG. 7, a ceiling implementation is shown. The speaker 108 is shown implemented, along with the fabric 104, as part of a ceiling tile (e.g., a ceiling tile in a drop ceiling arrangement). Such an implementation would allow the system 100 to be implemented in a ceiling.

The receiver 106 may be implemented in a variety of ways. In one example, the receiver 106 may include a Wi-Fi connection allowing streaming music files retrieved from the Internet to be played. With a Wi-Fi connection, the receiver 106 may be integrated into a house wide system. For example, such systems may allow the same music files to be streamed to both the system 100 (or 100') as well to other speakers mounted throughout an area. The receiver 106 may provide an application program interface (API) that may allow the receiver to connect with various brands of house wide speaker systems and/or music services. The receiver 106 may be implemented to be controlled by one or more buttons on the front of the receiver 106, the remote control 110, or through a smart phone based app (not shown). With a phone (or tabled) based app implementation, various automation features may be implemented. For example, a sleep time may be programmed. In an example, a programmed time to routinely start playing may be implemented.

The receiver 106 may be implemented as a infotainment headunit system. The headunit 106 may have various capabilities (e.g., USB, FM/AM, Bluetooth). The receiver 106 may be expanded to include, but not limited to be (i) voice activated, (ii) operate from a voice command, (iii) provide Internet streaming capabilities, (iv) be CD/DVD/BluRay capable, and/or (iv) provide music storage capabilities (various gigabyte capacities).

The system 100 may also be implemented in a variety of other ways. The system 100 may have many different images other than what is represented in the picture 120. In an example, the image 120 may be a sports celebrity. In another example, the image 120 may implement a political statement or a parody.

The system 100 may be implemented in existing piece of art. In an example, the speaker 108 or speakers 108*a*-108*n* and receiver system may be made part of a desk, shelving unit, or other piece of furniture. A variety of images 120, such as a framed concert or movie poster. In another example, the system 100 may be made part of a keepsake, such as framed tickets or souvenirs from a trip.

The apparatus 100 may be configured without the frame 102. The apparatus 100 may be comprised of flexible material 104 that stands alone on the floor or on a table. In an example, the system 100 may be part of a lamp with the speaker 108 affixed to a shade.

The terms "may" and "generally" when used herein in conjunction with "is(are)" and verbs are meant to communicate the intention that the description is exemplary and believed to be broad enough to encompass both the specific examples presented in the disclosure as well as alternative examples that could be derived based on the disclosure. The terms "may" and "generally" as used herein should not be construed to necessarily imply the desirability or possibility of omitting a corresponding element.

While the invention has been particularly shown and described with reference to embodiments thereof, it will be understood by those skilled in the art that various changes in form and details may be made without departing from the scope of the invention.

The invention claimed is:

1. An apparatus comprising:

a frame configured to provide a rigid edge about a generally rectangular shape;

a flexible material covering a front of said frame and secured to a back of said frame such that (i) said rigid edge supports said flexible material, and (ii) a middle portion of said flexible material is not supported by said frame, said flexible material having a hole;

a speaker connected directly to said middle portion of said flexible material through said hole at a location away from said rigid edge, said speaker having (i) a grill connected to a front portion of said flexible material and (ii) a fastener connected to a back portion of said flexible material; and a controller (i) electrically connected to said speaker though one or more wires and (ii) configured to provide a music signal through said wires capable of driving said speaker to produce audible music, wherein said flexible material supports said speaker and said controller.

2. The apparatus according to claim 1, wherein said flexible material is implemented as a photographic canvas.

3. The apparatus according to claim 1, wherein said speaker is attached to said grill with one or more screws passing through said flexible material.

4. The apparatus according to claim 1, further comprising a microphone configured to operate as a telephone.

5. The apparatus according to claim 1, further comprising a microphone configured to operate as a voice recognition device.

6. The apparatus according to claim 1, wherein the apparatus is implemented as an infotainment unit.

7. The apparatus according to claim 1, wherein the controller further comprises a Wi-Fi connection.

8. The apparatus according to claim 7, wherein the controller streams music files from an Internet source through the Wi-Fi connection.

9. The apparatus according to claim 1, wherein the controller is controlled by a smart phone app.

10. The apparatus according to claim 1, wherein the controller is configured to provide automated home control commands.

11. The apparatus according to claim 1, wherein the controller is configured to work with whole house speaker system through an application programming interface (API).

12. The apparatus according to claim 1, wherein the controller further comprises a bluetooth connection.

13. The apparatus according to claim 1, configured to be part of a lamp shade.

14. The apparatus according to claim 1, wherein said flexible material comprises hemp.

15. The apparatus according to claim 3, wherein said screws pass though one or more second holes in said flexible material.

* * * * *